US009511485B2

(12) United States Patent
Chang

(10) Patent No.: US 9,511,485 B2
(45) Date of Patent: Dec. 6, 2016

(54) WRENCH CAPABLE OF ADJUSTING OPERATING ANGLE

(71) Applicant: Chih-Min Chang, Changhua County (TW)

(72) Inventor: Chih-Min Chang, Changhua County (TW)

( * ) Notice: Subject to any disclaimer, the term of this patent is extended or adjusted under 35 U.S.C. 154(b) by 166 days.

(21) Appl. No.: 14/332,150

(22) Filed: Jul. 15, 2014

(65) Prior Publication Data

US 2016/0016297 A1 Jan. 21, 2016

(51) Int. Cl.
*B25B 23/00* (2006.01)
*B25B 13/48* (2006.01)
*B25B 13/04* (2006.01)

(52) U.S. Cl.
CPC ..... *B25B 23/0028* (2013.01); *B25B 13/481* (2013.01); *B25B 13/04* (2013.01)

(58) Field of Classification Search
CPC . B25B 23/0028; B25B 13/04; B25B 13/481; B25G 1/063
USPC ..... 81/177.8
See application file for complete search history.

(56) References Cited

U.S. PATENT DOCUMENTS 1,205,149 A * 11/1916 Bovee ..... B25G 1/063 81/177.9
6,823,762 B2 * 11/2004 Hu ..... B25B 23/0035 403/322.2
7,367,249 B1 * 5/2008 Chiang ..... B25B 23/0035 403/325
9,242,366 B2 * 1/2016 Liu ..... B25G 1/063
2011/0226099 A1 * 9/2011 Chen ..... B25B 13/04 81/177.8
2015/0328753 A1 * 11/2015 Chen ..... B25B 13/46 81/177.8

FOREIGN PATENT DOCUMENTS

TW I241940 10/2005

* cited by examiner

*Primary Examiner* — Hadi Shakeri
(74) *Attorney, Agent, or Firm* — Muncy, Geissler, Olds & Lowe, P.C.

(57) ABSTRACT

A wrench includes a handle having a notch, a radial hole, and an axial hole communicated with the notch and the radial hole, a wrench head pivotally connected with the notch by a pivot part on which a first positioning teeth part is provided, and a positioning assembly including a positioning member disposed inside the axial hole, and two control bolts disposed inside the radial hole. The positioning member has two first abutting members and a second positioning teeth part engaged with the first positioning teeth part. Each control bolt has a second abutting member abutted against one of the first abutting members of the positioning member. By such arrangements, when both of the two control bolts are pressed, the positioning of the wrench head by the positioning member can be released for facilitating adjustment of the operation angle of the wrench head.

3 Claims, 5 Drawing Sheets

WRENCH CAPABLE OF ADJUSTING OPERATING ANGLE

BACKGROUND OF THE INVENTION

1. Field of the Invention

The present disclosure relates to a wrench, and more particularly to a wrench capable of adjusting an operating angle.

2. Description of the Related Art

A wrench is a hand-held tool for rotating bolts, screw nuts or workpieces which are hard to be rotated manually. However, while the wrench is operated in a narrow operating space or an environment with block of structural object, the user must change his/her gripping angle frequently to exactly sleeve the wrench head onto the associated workpiece. Such operation approach is easy to bother the user.

In order to solve the problem, Taiwan Patent No. I241940 disclosed a mechanism for adjusting the angle of a wrench head, which adopts cooperation of a positioning rod and an adjustment rod provided between the wrench head and a wrench handle, respectively. However, in this prior art patent disclosure, the positioning rod and the adjustment rod are arranged in an inclined manner, which has the problems of complex structure and laborious operation, and the disadvantage that the positioning of the wrench head by the adjustment rod is not good enough. Therefore, it is necessary to improve the structure of the aforesaid wrench.

SUMMARY OF THE INVENTION

One of objectives of the present disclosure is to provide a wrench which is labor-saving, quick and positive in adjustment of the operation angle so as to enhance convenience of operation thereof.

To achieve the objective, the wrench of the present disclosure comprises a handle, a wrench head and a positioning assembly. The handle includes an acting part which has a notch, a radial hole and an axial hole communicated with the notch and the radial hole. The wrench head has a pivot part which is pivotally disposed in the notch of the handle, and a first positioning teeth part provided on an outer peripheral surface of the pivot part. The positioning assembly includes a positioning member, two control bolts, and two restoring springs. The positioning member is axial movably disposed inside the axial hole of the handle and has a second positioning teeth part at an end thereof The second positioning teeth part is engaged with the first positioning teeth part of the wrench head for clamping the wrench head. The positioning member has two first abutting members at the other end thereof. The two control bolts are axially movably disposed inside the radial hole of the handle and each have a second abutting member abutted against one of the first abutting members of the positioning member for positioning the positioning member. The two restoring springs are disposed inside the radial hole of the handle and abutted against the control bolts respectively for resetting the control bolts.

When both of the two control bolts are pressed, the second abutting members of the two control bolts release the force applied on the first abutting members of the positioning member to make the positioning member movable inside the axial hole of the handle, so that the clamping between the positioning member and the wrench head can be relieved, and the wrench head can be pivotally rotated relative to the handle to adjust the operation angle thereof.

DETAILED DESCRIPTION OF THE PREFERRED EMBODIMENTS

Figure 1:
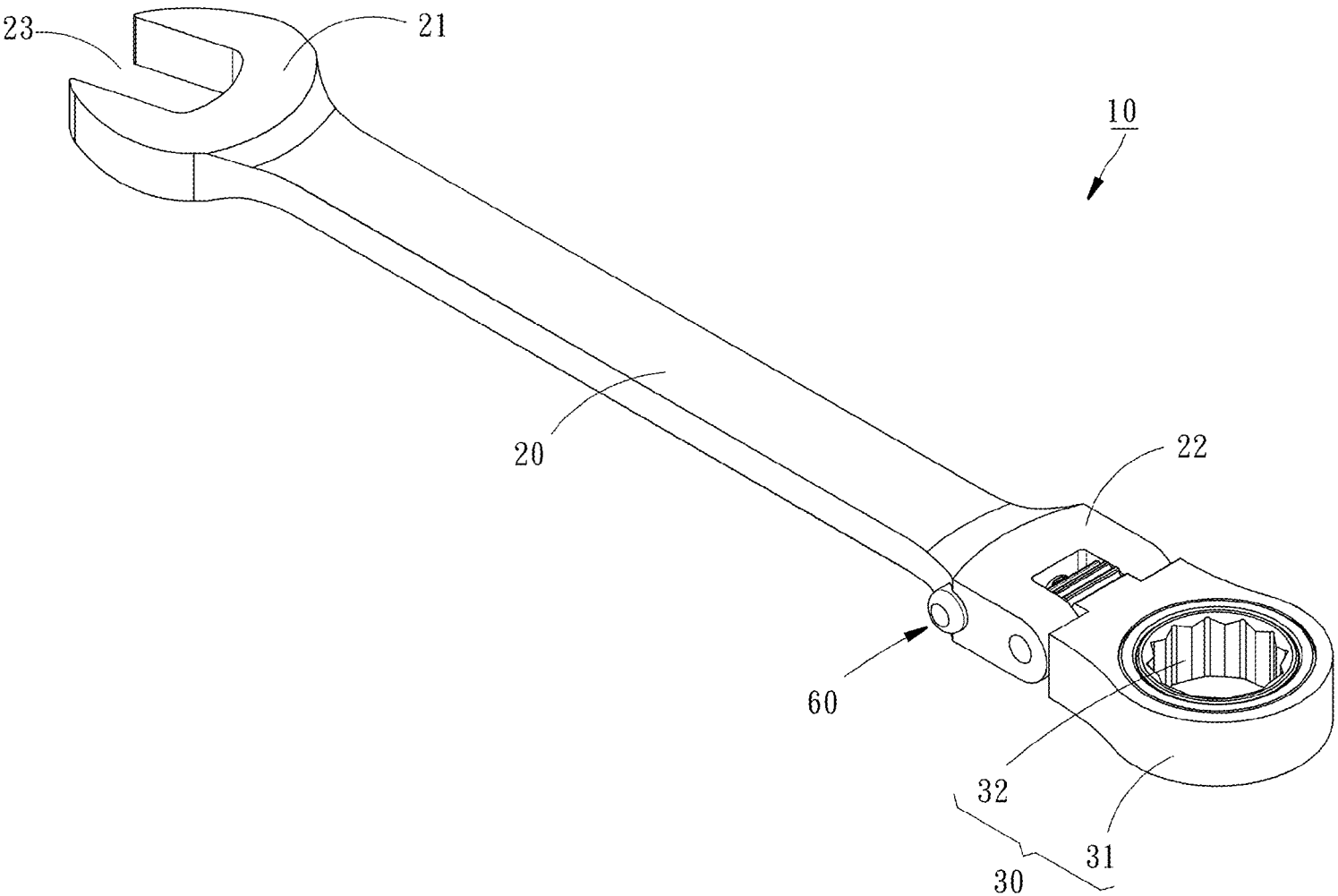
FIG. 1 is a perspective view of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Figure 2:
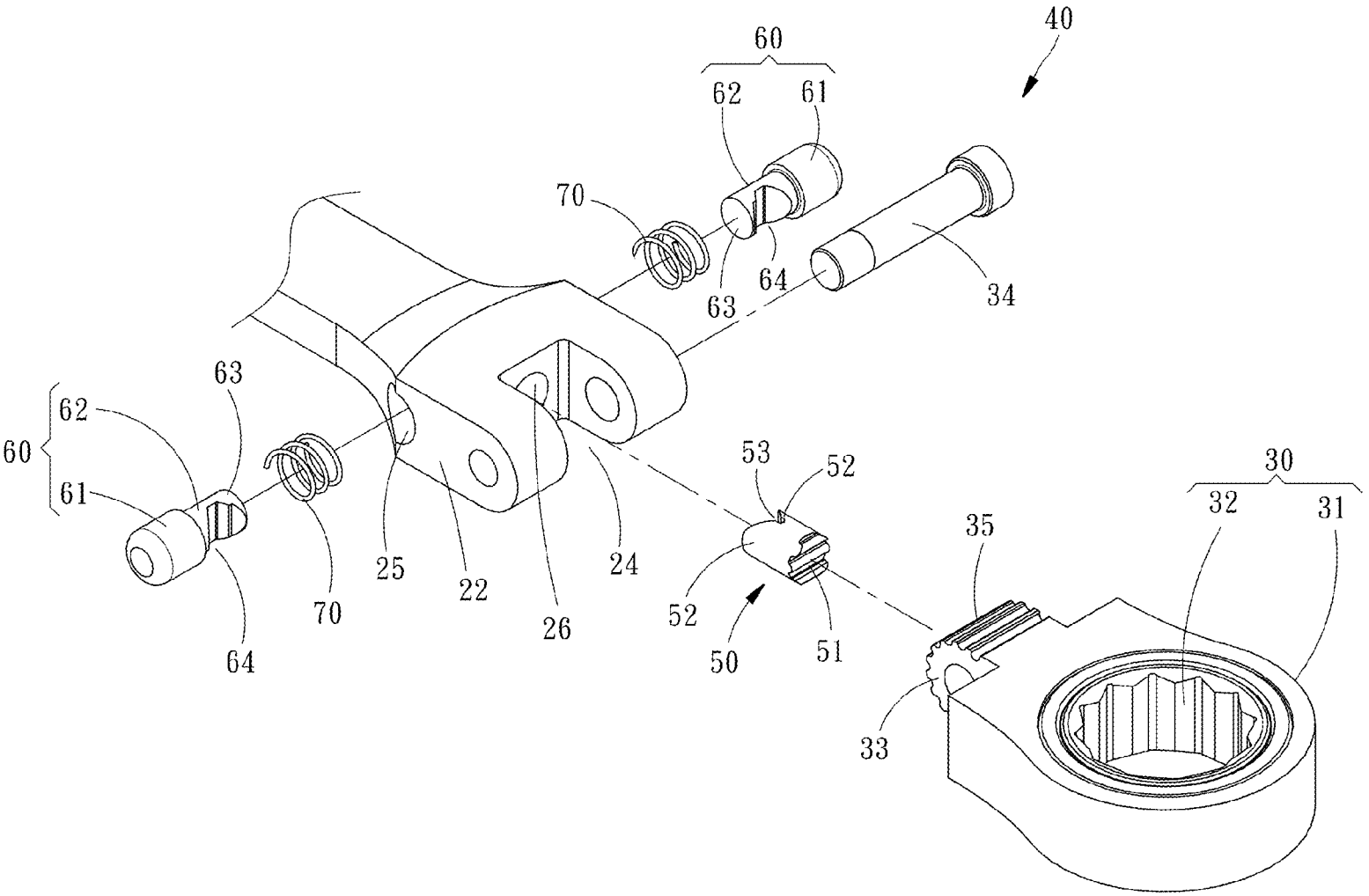
FIG. 2 is an exploded view of the present disclosure.

Referring to FIG. 1 and FIG. 2, the wrench 10 of the present disclosure comprises a handle 20, a wrench head 30 and a positioning assembly 40.

Figure 3:
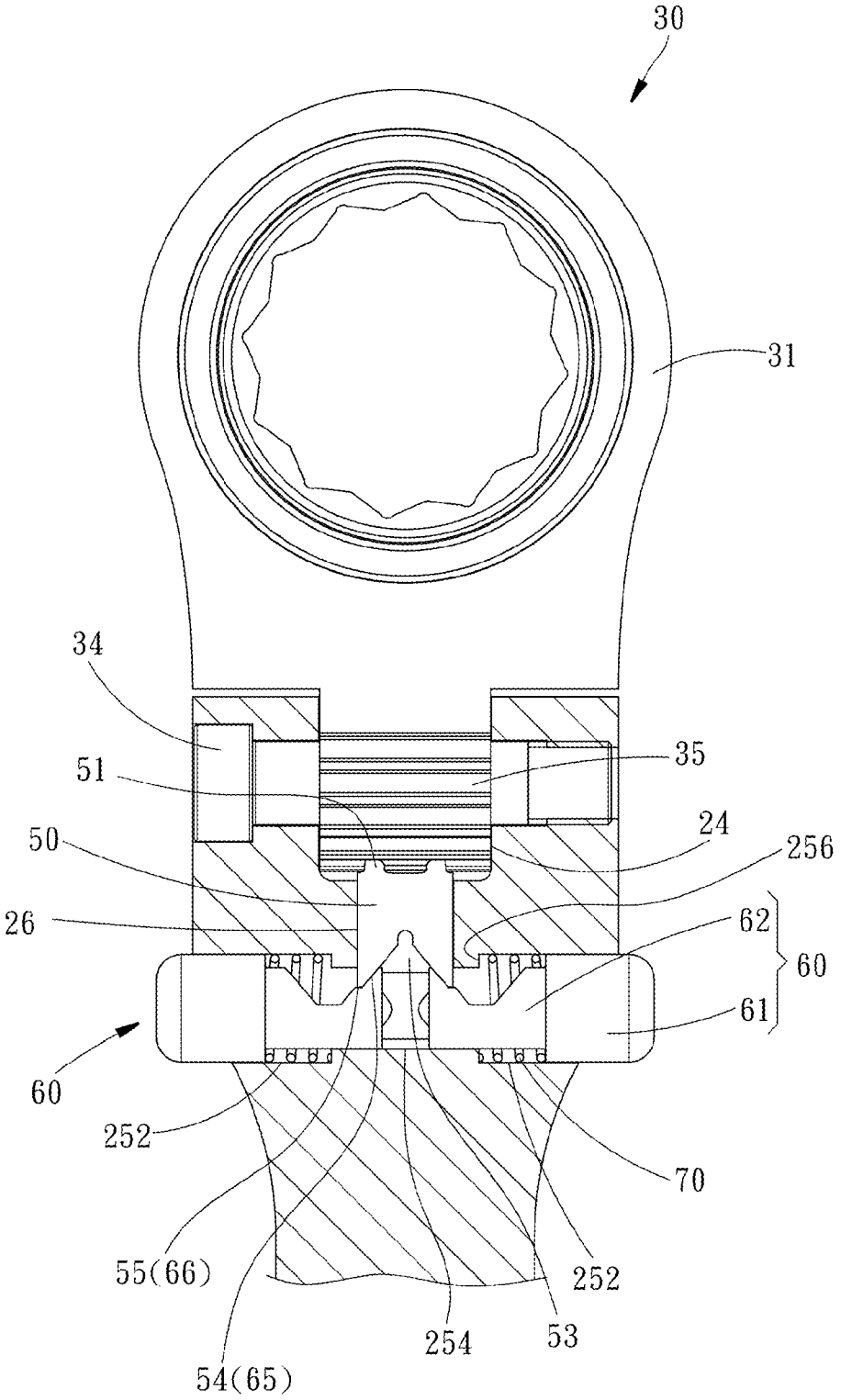
FIG. 3 is a partially cutaway view of the present disclosure, which shows that the control bolts are not pressed by external force yet.

The handle 20 has a first acting part 21 and a second acting part 22. The first acting part 21 has a U-shaped opening 23 for clamping a bolt or a screw nut, and the second acting part 22 has a notch 24, a radial hole 25 and an axial hole 26. As shown in FIG. 3, the radial hole 25 has two large diameter sections 252 and a small diameter section 254 communicated between the two large diameter sections 252, such that two shoulder parts 256 are formed between the small diameter section 254 and each of the two large diameter sections 252, respectively. In addition, the axial hole 26 communicates with the notch 24 and the small diameter section 254 of the radial hole 25.

The wrench head 30 has a body 31 and a ratchet wheel 32 rotatably disposed in an opening of the body 31. The body 31 has a pivot part 33 at a side thereof. The pivot part 33 is accommodated inside the notch 24 of the handle 20 and pivotally connected with the handle 20 by a pivot 34. In addition, a first positioning teeth part 35 is provided on the outer peripheral surface of the pivot part 33.

The positioning assembly 40 has a positioning member 50, two control bolts 60 and two restoring springs 70.

As shown in FIG. 2 and FIG. 3, the positioning member 50 is axially movably disposed inside the axial hole 26 of the handle 20 and has a second positioning teeth part 51 at an end thereof. The positioning member 50 engages with the first positioning teeth part 35 of the wrench head 30 by the second positioning teeth part 51 for clamping and holding the wrench head 30 in position. The positioning member 50 is provided at the other end thereof with two first abutting members 52 opposite to each other, and a first gap 53 between the two first abutting members 52. Each of first abutting members 52 has a first inclined plane portion 54 and a first abutting plane portion 55 connected with the first inclined plane portion 54.

As shown in FIG. 2 and FIG. 3, each of the control bolts 60 is axially movably disposed inside the radial hole 25 of the handle 20 and has a head part 61 and a body part 62. A portion of the head part 61 is exposed out of the radial hole 25 of the handle 20 for being pressed by the user. The body part 62 axially extends outwardly from the head part 61 and has a second abutting member 63 and a second gap 64 adjacent to the second abutting member 63. The second abutting member 63 is accommodated inside the first gap 53 of the positioning member 50 and has a second inclined plane portion 65 and a second abutting plane portion 66 connected with the second inclined plane portion 65. The second inclined plane portions 65 of the second abutting members 63 of the control bolts 60 are abutted against the first inclined plane portions 54 of the first abutting members 52 of the positioning member 50 respectively, and the second abutting plane portions 66 of the second abutting members 63 of the control bolts 60 are abutted against the first abutting plane portions 55 of the first abutting members 52 of the positioning member 50 respectively.

As shown in FIG. 2 and FIG. 3, each of restoring springs 70 is sleeved onto the body part 62 of one of the control bolts 60 and abutted against one of the shoulder parts 256 of the radial hole 25 of the handle 20 and an end surface of one of the head parts 61 of the control bolts 60 for providing restoring power to the control bolt 60.

By the above-mentioned structure, when the two control bolts 60 are not pressed yet, as shown in FIG. 3, the second inclined plane portions 65 of the second abutting members 63 of the control bolts 60 are abutted against the first inclined plane portions 54 of the first abutting members 52 of the positioning member 50 due to the restoring force applied on the control bolts 60 by the restoring springs 70, and the second abutting plane portions 66 of the second abutting members 63 of the control bolts 60 are also abutted against the first abutting plane portions 55 of the first abutting members 52 of the positioning member 50. In this situation, the positioning member 50 is constrained by the two control bolts 60 and unable to move inside the axial hole 26 of the handle 20. Therefore, while the positioning member 50 cannot act, the wrench head 30 cannot be rotated relative to the handle 20 because of being clamped with the positioning member 50, that is, the operation angle of the wrench head 30 cannot be adjusted.

Figure 4:
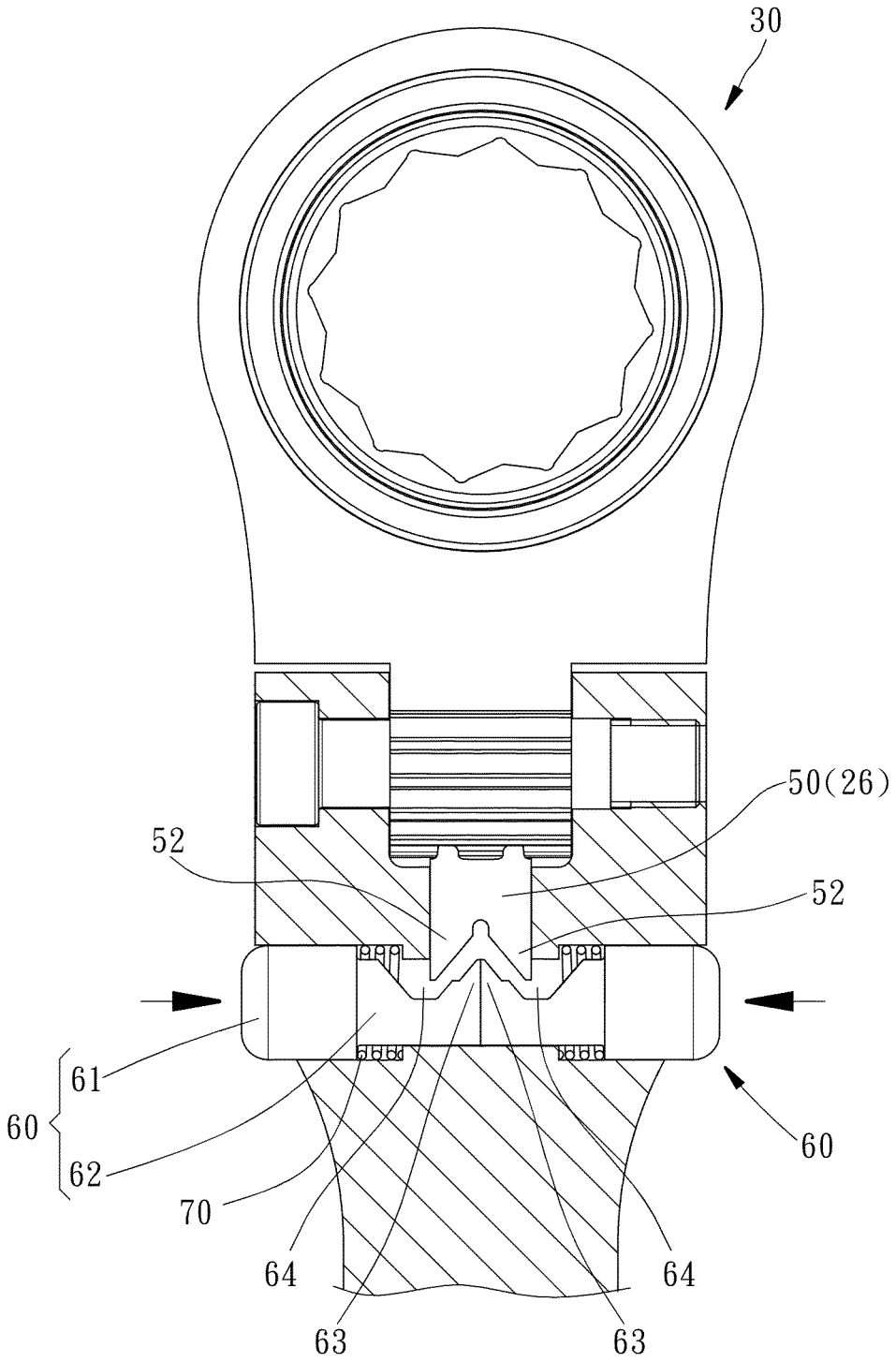
FIG. 4 is similar to the FIG. 3, but showing that the control bolts are pressed.
Figure 5:
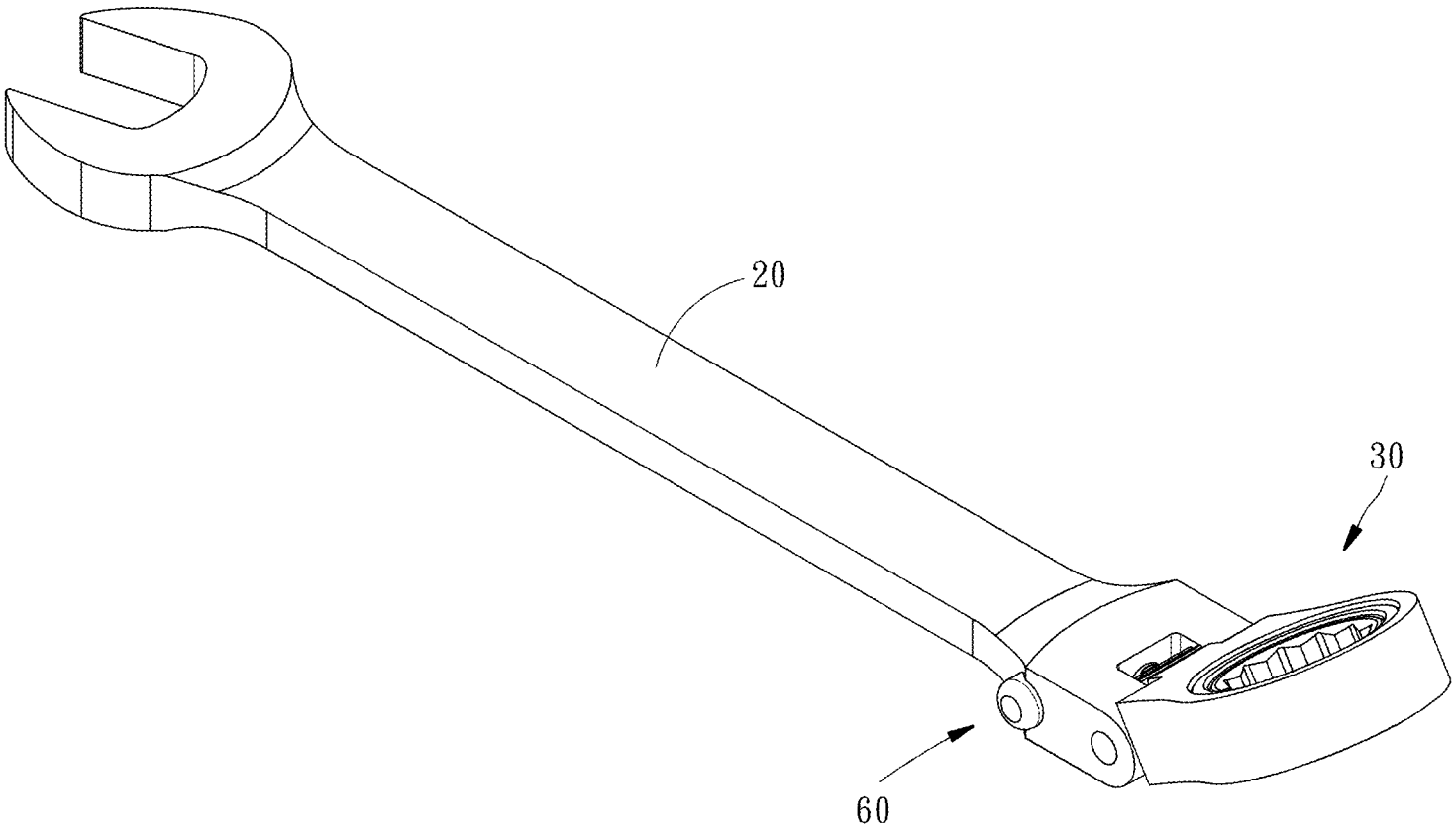
FIG. 5 is another perspective view of the present disclosure, showing that the wrench head is adjusted to a desired operation angle.

When it is desired to adjust the operation angle of the wrench head 30, as shown in FIG. 4, both of the head parts 61 of the two control bolts 60 should be pressed firstly to force the two control bolts 60 to approach each other for compressing the restoring springs 70. While the two control bolts 60 move toward each other, the first abutting members 52 of the positioning member 50 are accommodated inside the second gaps 64 of the control bolts 60 to prevent from generating interference between the body parts 62 of the control bolts 60 and the first abutting members 52 of the positioning member 50, and the second abutting members 63 of the control bolts 60 depart from the first abutting members 52 of the positioning member 50. In this way, the two control bolts 60 release the force clamping the positioning member 50, and the positioning member 50 then is movable inside the axial hole 26 of the handle 20, such that the engagement of the positioning member 50 with the wrench head 30 is relieved. In this situation, the wrench head 30 can be pivotally rotated relative to the handle 20 to adjust the operation angle thereof, as shown in FIG. 5. After the wrench head 30 is adjusted to an appropriate operation angle, the two control bolts 60 can be released, and the second abutting members 63 of the two control bolts 60 will abut against the first abutting members 52 of the positioning member 50 again to complete the positioning of the wrench head 30.

In summary, the wrench 10 of the present disclosure applies the cooperation of the two control bolts 60 opposite to each other and the positioning member 50 to adjust the operation angle of the wrench head 30. Compared with prior art, the wrench 10 of the present disclosure is more labor-saving, quicker and more convenient in operation, and the positioning effect of the wrench head 30 is also enhanced. Therefore, the objective of the present disclosure can be achieved.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A wrench capable of adjusting an operating angle, comprising:

a handle including an acting part having a notch, a radial hole and an axial hole in communication with the notch and the radial hole;

a wrench head having a pivot part pivotally disposed in the notch of the handle, and a first positioning teeth part provided on an outer peripheral surface of the pivot part; and a positioning assembly including a positioning member axially movably disposed inside the axial hole of the handle and provided at an end thereof with a second positioning teeth part engaged with the first positioning teeth part of the wrench head and at the other end thereof with two first abutting members, two control bolts axially movably disposed inside the radial hole of the handle and each having a second abutting member abutted against one of the first abutting members of the positioning member, and two restoring springs disposed inside the radial hole of the handle and abutted against the control bolts, respectively;

wherein the positioning member further has a first gap located between the two first abutting members for accommodating the second abutting members of the two control bolts, and each of the control bolts further has a second gap, the second gap being adjacent to the second abutting member for accommodating one of the first abutting members of the positioning member.

2. The wrench as defined in claim 1, wherein each of the first abutting members of the positioning member has a first inclined plane portion and a first abutting plane portion connected with the first inclined plane portion, and the second abutting member of each of the control bolts has a second inclined plane portion abutted against the first inclined plane portion of one of the first abutting members of the positioning member, and a second abutting plane portion connected with the second inclined plane portion and abutted against the first abutting plane portion of one of the first abutting members of the positioning member.

3. The wrench as defined in claim 2, wherein the radial hole of the handle has two large diameter sections and a small diameter section connected between the two large diameter sections and communicated with the axial hole, such that two shoulder parts are formed between the small diameter section and each of the two large diameter sections, respectively; each of the control bolts has a head part exposed out of the radial hole of the handle, and a body part extending outwardly from the head part and having the second abutting member; each of the restoring springs is sleeved onto the body part of one of the control bolts and abutted against one of the shoulder parts of the radial hole of the handle and an end surface of the head part of one of the control bolts.

* * * * *